US010010120B1

(12) United States Patent
Lowe

(10) Patent No.: US 10,010,120 B1
(45) Date of Patent: Jul. 3, 2018

(54) SWIM GARMENT WITH ADJUSTABLE WAISTBAND

(71) Applicant: Jennifer Diane Lowe, San Diego, CA (US)

(72) Inventor: Jennifer Diane Lowe, San Diego, CA (US)

( * ) Notice: Subject to any disclaimer, the term of this patent is extended or adjusted under 35 U.S.C. 154(b) by 0 days.

(21) Appl. No.: 13/917,611

(22) Filed: Jun. 13, 2013

Related U.S. Application Data

(60) Provisional application No. 61/658,923, filed on Jun. 13, 2012.

(51) Int. Cl.
*A41D 5/00* (2006.01)
*A41D 7/00* (2006.01)

(52) U.S. Cl.
CPC ..... *A41D 7/00* (2013.01)

(58) Field of Classification Search
CPC ..... A41D 7/00; A41B 9/06; A41C 1/00
USPC ..... 2/67, 73; 450/107
See application file for complete search history.

(56) References Cited

U.S. PATENT DOCUMENTS

| | | | | | |
|---|---|---|---|---|---|
| 1,390,135 | A * | 9/1921 | Jantzen | 2/67 | |
| 2,099,885 | A * | 11/1937 | Mogens | 2/67 | |
| 3,654,630 | A | 4/1972 | Block | | |
| 4,121,305 | A | 10/1978 | Kolker | | |
| 5,991,920 | A * | 11/1999 | Holland | A41D 7/005 | 2/247 |
| 6,016,569 | A * | 1/2000 | Everett et al. | 2/67 | |
| 6,035,439 | A * | 3/2000 | Chin | A41B 9/08 | 2/408 |
| 6,085,356 | A | 7/2000 | Redmond, Sr. | | |
| 6,240,560 | B1 | 6/2001 | DeCaro | | |
| 6,823,530 | B2 * | 11/2004 | Quincy, III | 2/67 | |
| 7,168,096 | B1 * | 1/2007 | Landa | A41C 3/0021 | 2/67 |
| 59,498 | A1 | 3/2013 | Hersh | | |
| 8,429,762 | B2 | 4/2013 | Weisman | | |
| 8,832,862 | B1 * | 9/2014 | Solis | 2/67 | |
| 2004/0083537 | A1 * | 5/2004 | Mosha | A41B 9/002 | 2/400 |

FOREIGN PATENT DOCUMENTS

| | | | |
|---|---|---|---|
| EP | 2309883 | B1 | 10/2012 |
| WO | WO 1998056328 | A1 | 12/1998 |
| WO | WO 2004077973 | A1 | 3/2004 |
| WO | WO 2004049840 | A1 | 6/2004 |

* cited by examiner

*Primary Examiner* — Tejash Patel
(74) *Attorney, Agent, or Firm* — TJSL Patent Clinic; Ryan Kuhn; Matthew Johnson

(57) ABSTRACT

The present invention provides a garment useful as swimwear or sun-bathing attire that has an adjustable waistband which allows the girth of the garment and waistband to be expanded or decreased by the user, according to the body size and desired fit of the user. Swim garment includes a front panel, a rear panel, and sliding adjustable straps that connect the front panel to the rear panel. Said sliding adjustable straps permit lengthening or shortening thereof by accumulation of material, in the manner of a bra strap, and compose an adjustable section of the garment's adjustable waistband.

7 Claims, 8 Drawing Sheets

SWIM GARMENT WITH ADJUSTABLE WAISTBAND

CROSS REFERENCE TO RELATED APPLICATIONS

This application claims the benefit of provisional U.S. patent application Ser. No. 61/658,923, filed Jun. 13, 2012, entitled "ADJUSTABLE SWIMWEAR WITH ADJUSTABLE SLIDING WAISTBAND STRAPS AND OR HIP STRAPS."

FIELD OF THE INVENTION

This invention relates to swimwear garments, and more particularly, a swimsuit with an adjustable waistband capable of giving swimsuit wearers a more flattering and comfortable fit.

BACKGROUND OF THE INVENTION

Wearers of swimwear seek a fit that compliments their body shape. However, many swimsuits have elasticized waistbands which are not adjustable and commonly constrict and squeeze the skin of the wearer tightly, causing an unsightly, uncomfortable and embarrassing bulge of skin atop the waistband of the swimsuit in use. This has caused difficulty among a wide range of women who would like to find a flattering or unconstricting fit in a swim garment. Many women feel that it is difficult enough to look their best in a swimsuit, but add in the elastic waistband factor that often causes unnecessary rolls or bulges in the skin, and the challenge becomes puzzling.

This waistband bulge problem does not only haunt bikini or two-piece swimsuit wearers. This bulging problem around elastic waistbands has discouraged women of different shapes and sizes to the point that some shy away from swimwear all together. Even women who seek a one-piece swimsuit for the modesty or coverage offered by such a suit are often disappointed by the squeezing near the waist or hip area, and around the elasticized legs as well.

It has become commonplace to avoid this problem by use of swimwear found in prior art that have ties on the sides of the garment, offering a level of adjustability in the waist, hip, and leg opening area, often found in two-piece swimwear. However, it is often difficult to find a one-piece swimsuit with such side ties and adjustability. Further, the wearer is then often confined to wearing swimsuits with ties if they want to achieve a fit with no waistband bulge, which denies the wearer of variety of styles in their swimsuit wardrobe. Also, ties are bulky, so when a wearer puts another garment over the swimsuit, such as a cover-up, a dress, or pants, the swimsuit ties then cause unattractive bumps that can be seen through the fabric of the outer garment. Additionally, ties are inefficient because they can easily come untied by accident or by jokesters.

In analyzing prior art, many inventors have attempted to offer a solution of an adjustable waistband in different types of garments, but have not yet revealed a solution that is suitable for form-fitting swimwear. There have been various attempts by inventors at creating adjustability means for various aspects of swimwear, but have not addressed the specific need of a swim garment with a simple means of adjusting the waistband, for a comfortable flattering fit with no ties, that is suitable for ladies swimwear, that would solve the problem of elastic waistband induced bulge, and would appeal to and accommodate a wide range of womens' bodies.

Block, U.S. Pat. No. 3,654,630 teaches an adjustable swim and sun suit panty garment in which the waistband is adjustable height-wise, but not in a lateral fashion that would lend it to accommodate variable girth at the waistband.

Procter and Gamble Company, WO 1998056328 A1 teaches an absorbent disposable article with adjustable waist feature. This garment features an adjustability feature that adjusts the diaper both laterally for girth of waist with adhesive, and longitudinally through inward folding. Both of these adjustability features work for this type of disposable garment, but are not suitable, convenient, or practical for swimwear or swim fashion styles.

Weisman, U.S. Pat. No. 8,429,762 B2 teaches an "Adjustable bathing suit" which is a man's boardshort type swimsuit that has an adjustable waistband which is achieved with a series of button holes on a strap and a button that is concealed on the inside the front center of the swimsuit waistband. However, such a device would not be suitable for use with form fitting or stretch fabrics as commonly used for ladies swimwear because the strap would be visible through the fabric. Further, this type of adjustment means is limiting because only the predetermined size increments defined in the distance from one hole to another on the concealed strap could be achieved, and if a person's waist girth were between incremental holes, a wearer's desired fit could not be achieved.

DeCaro, U.S. Pat. No. 6,240,560 teaches a "Versatile swimsuit with accessories" wherein many alternative accessories may be hooked onto the swimsuit to create various looks. One embodiment allows for waistband adjustment of the swimsuit panty by providing additional pieces of fabric that may be attached to the garment through a hook and eye fastening system, which can then be tied into bows. This method of achieving a desired waistband width is laborsome and bulky. These extra pieces are detachable so they may be lost between uses of the garment, or may even fall off during use of the garment, which would be embarrassing and irritating to the wearer.

Kolker, U.S. Pat. No. 4,121,305 teaches a G-string type panty that includes a triangular front panel, no rear panel, and a series of elastic strings and loops to attach the front panel to the body. The strings are passed through a tube in the top of the front panel, and then tied by the user in such a way as a drawstring is tied. This type of adjustable panty is not suitable for swimwear due to lack of coverage possibilities, and also because the drawstring-type tie at the top is bulky and inconvenient.

Redmond, U.S. Pat. No. 6,085,356 teaches a detachable waist band expander. The insert attaches to the button slit in the user's clothing, and offers a small amount of expansion in the waistband of the garment. This invention is not preferable for ladies swimwear because swimsuits generally have a continuous waistband, and do not generally have buttons connecting two sides of a waistband.

Smith, World Patent No. WO 2004077973 A1 teaches a G-String type thong panty that may be used for underwear or swimwear, which exclusively consists of a front panel, and three thin straps. These three straps are the only components of the backside of the garment, and are attached to one another at a "Y" shaped "junction" below the top of the crevice of the buttocks, exposing the top of the crevice of the buttocks, which could cause bulk in an uncomfortable place between the buttocks. Such a "junction" of three straps sewn together and joined within the crevice of the buttocks could be uncomfortable to the wearer, especially when sitting or walking. One embodiment therein, includes the upper straps may have adjustment means.

However, WO 2004077973 A1 is limiting because there is no rear panel as part of the invention, and the straps only connect to the front panel and to each other, causing the backside of the wearer to be exposed. The entire backside of the garment is made of 3 thin straps defined as "typically 5-10 mm wide," which specifically are only attached to the front panel, and to each other at a "Y" shaped "junction." The straps form a definitively low fitting G-String. Said invention WO 2004077973 A1 also delivers a disadvantage to women who need or who would prefer to have coverage on their backside due to modesty, various body confidence levels, or even legal concerns. Most public pools and beaches do not allow G-string type panty garments to be worn. This type of intimate garment, while suitable for underwear, is lacking and limited in its ability to offer a wide range of women a comfortable solution for better-fitting swimwear, and is not a solution that can be incorporated into various swimwear styles.

In contrast, present invention provides a rear panel as part of the garment, providing coverage in the rear. Rear panel allows rear coverage which may vary among cut and style of embodiment, allowing invention to accommodate a range of women with various comfort and modesty levels and requirements. Further, present invention teaches that the adjustable straps connect to the front and rear panels, and do not connect at any point to other straps and therefore do not form any strap-to-strap junctions. This substantial difference in structure offers greater comfort to the wearer, because it: allows wearer to have a more comfortable crotch section which would be absent of thin straps, allows more coverage in the rear section by requiring a rear panel to be present for the straps to attach to, prevents uncomfortable bulk that would be formed by a junction of straps between the buttocks, and allows a great range of swimsuit or bikini styles, or coverage levels a wearer could incorporate into their swimwear wardrobe.

SUMMARY OF THE INVENTION

Disclosed is a garment intended for use as swimwear, or for sunbathing and the like, which incorporates means for simply and neatly adjusting the girth of the waistband of the garment by lengthening or shortening adjustable straps that compose a portion of the waistband. Straps are adjusted by accumulation of material, in the manner of a bra strap, through a sliding motion of adjustment members. Leg openings may also be made adjustable due to the adjustability of the waistband, or through repeated placement of adjustable straps along the side(s) of the garment. Such an adjustable waistband compliments ladies swimwear because it is not bulky, and may lay snugly against the skin as to blend smoothly with the form-fitting stretch fabrics used in ladies swimwear.

The waistband shall be adjusted to fit the individual's body dimensions near the waist and/or hip areas, as to provide a flattering fit while still providing enough grip of the body to hold the garment in place. Further, for times when the wearer wears the garment into the water and would like to tighten the straps for added security, the swimsuit is readily and easily adjustable while on the body by use of the adjustable straps on the waistband.

The fabrics used in construction of garment according to the invention are substantially similar to the fabrics used in conventional swimwear, being slightly stretchy fabrics including but not limited to LYCRA®, spandex, elastane, other stretchy nylon or polyester blends and the like. The skilled tradesman will be able to select appropriate fabrics, materials, and combinations, according to known parameters for swimwear.

The term "waistband" as it is used in this specification, refers to a circumferential opening in the garment constructed by the joining of the front panel, rear panel, and adjustable straps, or combinations thereof, and various embodiments may position the waistband at a range from high on the torso, to low on the hips or upper legs. The term "waistband" is not to be limiting, and may refer to the girth of the garment at any placement on the body. Adjustability of said waistband can and will often make entire lower region of garment adjustable in width, and adjustability is not limited to waistband region of garment. For example, in many swimsuits, an adjustable waistband also creates adjustability of the girth of leg openings.

The front panel and rear panel of the adjustable swimwear garment retain the reference thereof, based on the sections of the body they cover, regardless of variances in manufacture or embodiment: such as a single panel being constructed of multiple pieces of fabric joined together, or such as both front and rear panels of the garment being constructed of one continuous piece of fabric that has been fashioned as such to cover both the front and rear sections of the body.

Use of the term "bikini bottom" in this specification refers to the bottom piece of a presumed two-piece style swimsuit, wherein the top piece is not disclosed or relevant to present invention. The term "bikini" in no way limits the cut, coverage, or style of the garment. Regarding present invention, either or both the front panel or the rear panel of garment may be cut and manufactured into varying patterns, reflecting different styles and fashions providing various sizes, and levels of coverage or modesty.

In this specification, use of the terms "bra strap" or "adjustable strap" refer to straps containing adjustment means which are used to compose the adjustable section of the waistband in the swim garment with adjustable waistband. The use of such terms is intended to illustrate the length adjustability means of the straps, and in no way limits the size, shape, length or material of said strap. Bra straps, adjustable straps, or the like as a component of the garment's waistband, may be of various widths, lengths, or materials, depending on the desired look of the garment's waistband portion, and overall look of the garment. These variances of size, shape, length and material, may and will often deviate from any predetermined standard sizes of traditional bra straps, and may differ in methods of manufacture, provided that the sliding adjustability means of a bra strap is delivered. Adjustable straps and adjustment members therein may be made of various materials such as elasticized fabrics, swimwear fabrics, decorative fabrics, and/or decorative or embellished plastics, metals, natural stones, wood, woven elastic, rubber, neoprene, or other materials.

Objectives

It is an objective of the present invention to provide a swimsuit garment that is adjustable in the girth of the waistband in order to give wearers a flattering fit, and to avoid "digging" or "waistband bulges" that are often caused by traditional elasticized waistbands.

It is an objective of the present invention to provide a means of adjustable waistband swimwear that can be incorporated into various swim fashion styles, of various levels of coverage, such that women with differing tastes and/or body structures may enjoy the benefits thereof that they may achieve a smooth flattering fit in the waistband and/or hip area when wearing such garment.

It is an objective of the present invention to provide a swimsuit garment with an adjustable waistband that does not utilize ties.

It is an objective of the present invention to provide a swimsuit garment with an adjustable waistband that utilizes one or more sliding adjustable straps similar to bra straps or the like as means for it's adjustability. It is an objective of present invention, Swim garment with adjustable waistband, to offer benefits to wearers such as the ease of use and efficiency of adjustable waistband's adjustment means, sleek look that can be achieved with absence of bulky ties, as well as the variety of looks or coverage levels various embodiments will allow.

Advantages

Present invention provides improvement and advantages over the deficiencies of prior art, because present invention:

1. offers a solution to the problem of "waistband bulge" more efficiently, and in a manner that will appeal to a wide range of women of various shapes and sizes.
2. provides a sliding adjustability feature that offers a quick, simple, attractive way to achieve a customized desired girth of the waistband, leg openings, and garment as a whole, without bulky ties.
3. provides means of adjustment within the waistband which are unobvious and often inconspicuous, which allows wearer to enjoy the flattering fit of the swim garment, without causing embarrassment by drawing attention to the wearer's need for an adjustable waistband.
4. provides a rear panel as part of the garment, providing coverage in the rear. Rear panel allows rear coverage which may vary between cut and style of embodiment, which will accommodate a range of women with various comfort and modesty levels and requirements.
5. provides a waistband that does not visibly dip down into the buttocks.
6. provides a method of adjustability within the garment that is suitable to be used with swimwear made of form-fitting and stretchy fabrics, and can be manufactured in a variety of fashions to achieve various desired looks and styles.

These and other advantages of one or more aspects will become apparent upon consideration of the ensuing description and accompanying drawings.

DETAILED DESCRIPTION OF THE INVENTION

Figure 1A:
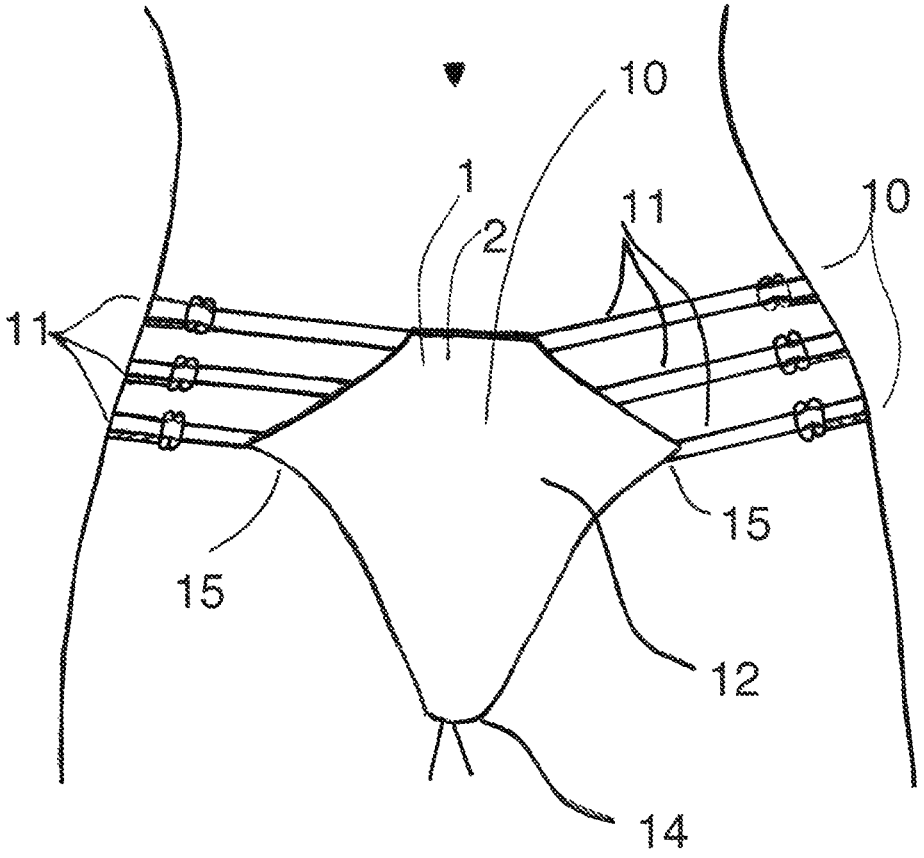
FIG. 1*a* is a front view of the swimsuit garment with adjustable waistband. Example of bikini bottom with multiple straps embodiment

Detailed embodiments of the present invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Referring now to the figures, the present invention, adjustable waistband swim garment 1 is constructed of expandable material or fabrics having elastic properties allowing the bathing suit to fittingly conform to the individual. Those skilled in the trade will be able to select suitable materials. Adjustable waistband swim garment 1 is comprised of a front panel 12, a rear panel 13 and sliding adjustable straps 11 that connect the front panel 12 to the rear panel 13 of the garment. Said sliding adjustable straps 11 permit lengthening or shortening thereof by accumulation of material, in the manner of a bra strap. In preferred embodiments, the front panel 12 and the rear panel 13 are connected on the sides of the garment by the adjustable straps 11 above the leg opening(s) 15 providing an adjustable fit in the waistband 10 of the garment. In this embodiment, the front panel 12 and rear panel 13, are connected at a crotch portion 14, with leg openings 15 adjacent to the crotch portion.

Figure 1B:
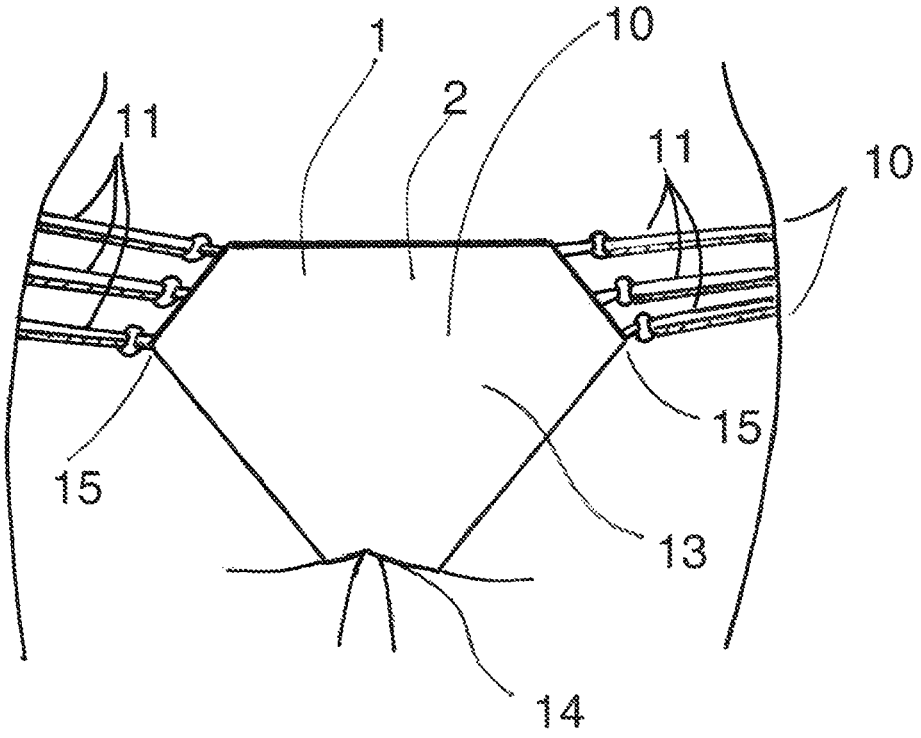
FIG. 1*b* is a back view of the swimsuit garment with adjustable waistband. Example of bikini bottom with multiple straps embodiment
Figure 1C:
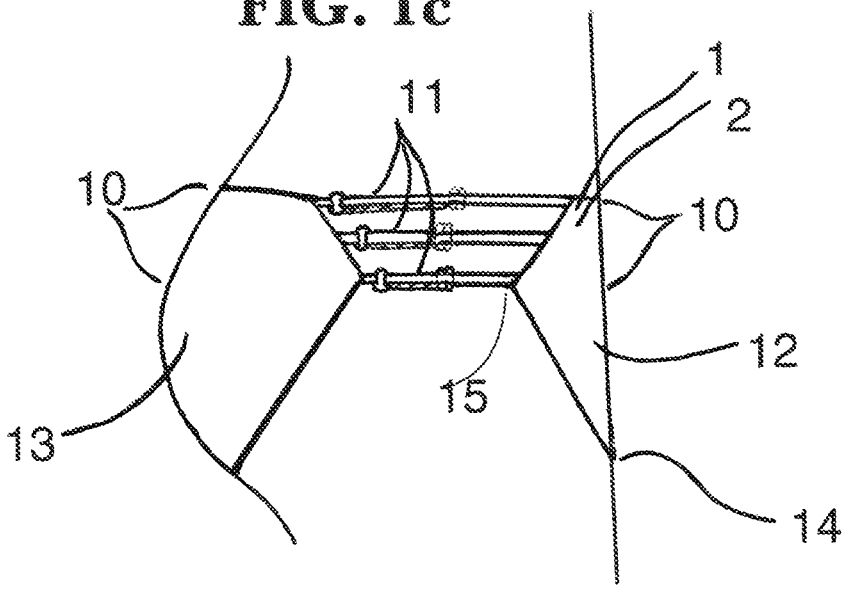
FIG. 1*c* is a side view of swimsuit garment with adjustable waistband. Example of bikini bottom with multiple straps embodiment

FIGS. 1*a*, 1*b*, and 1*c* display an embodiment of the adjustable swim garment 1, wherein the style is a bikini bottom 2, "bikini bottom" meaning bottom piece of a presumed two-piece style swimsuit, wherein the top piece is not disclosed or relevant to present invention. In the shown bikini embodiment 2 of present invention 1, the components of the waistband section 10 of the garment include, but are not limited to, the adjustable straps 11 which connect the front 12 and rear 13 panels, and the area of the front panel 12 and rear panel 13 adjacent to the connecting adjustable straps 11.

This bikini embodiment 2 utilizes a plurality of adjustable straps 11, to comprise the adjustable section of the waistband 10. In the bikini style embodiment 2, when the user lengthens or shortens the adjustable straps 11; the width of the waistband 10, the width of the leg-openings 15, and the overall girth of the bikini garment 2, are all adjusted. The lengthening and shortening function of the adjustable straps 11 allows user to adjust the girth of the waistband 10 leg openings 15, and swim garment 1, 2 to desired girth, providing a desired fit for the user.

Figure 2A:
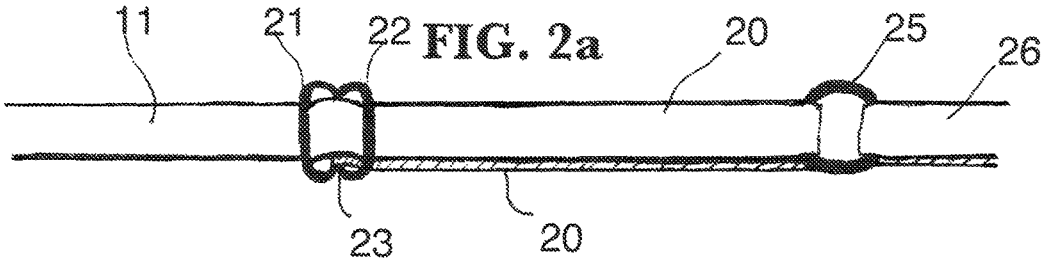
FIG. 2*a* is an enlarged cut away view of the adjustable bra-strap-like straps and its general components in one variation of embodiment.
Figure 2B:
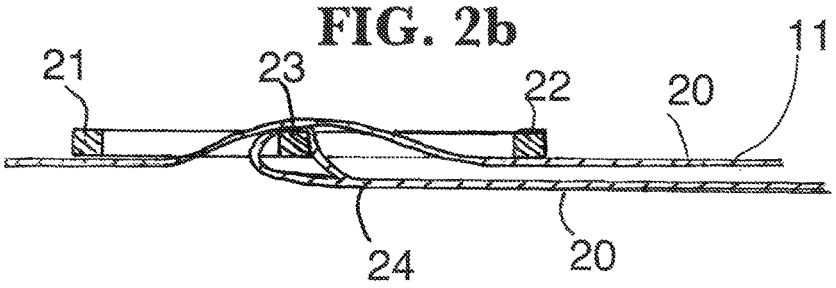
FIG. 2*b* is an enlarged cut away cross sectional view of the adjustable bra-strap-like straps and its general components in one variation of embodiment.

FIGS. 2*a* and 2*b* display an enlarged embodiment of the bra-strap-like adjustable strap 11, and it's components that offer the adjustability benefit thereof. The adjustable strap 11, includes a strap material 20, which passes under adjustment member 21, over adjustment member 23, and under adjustment member 22. Then the length of the strap material 20 passes through looped adjustment member 25, and folds behind strap material 20, then the strap end 24 is anchored to adjustment member 23. Strap attachment section 26 is part of adjustable strap 11, and is material that is used to attach the adjustable strap 11 to panel(s) 12, 13 in the manufacture of the swim garment 1, however strap attachment section 26 is not necessary in all embodiments, and may be omitted from adjustable strap 11 if looped adjustment member 25 is attached directly to or is part of adjacent connecting panel (front or rear) 12, 13. Similar manners of strap material 20 accumulation may be achieved through various embodiments; FIGS. 2*a* and 2*b* display an example of preferred embodiment of adjustable bra-strap-like straps 11, and is not to be considered limiting in structure.

Figure 3A:
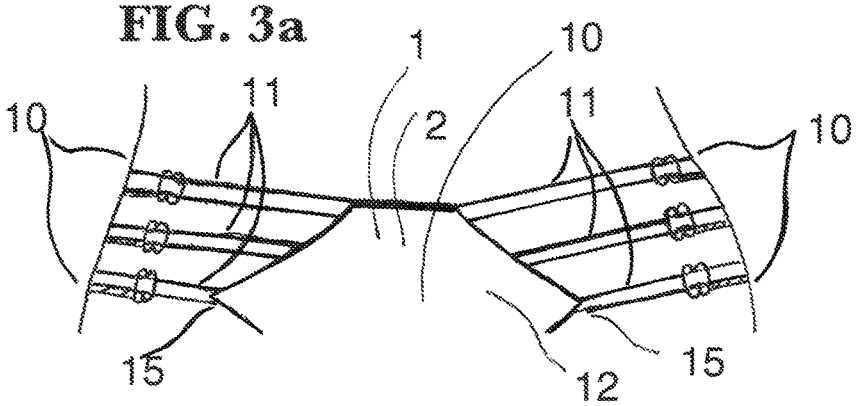
FIG. 3*a* is a frontal cut away view of the garment with adjustable waistband section.
Figure 3B:
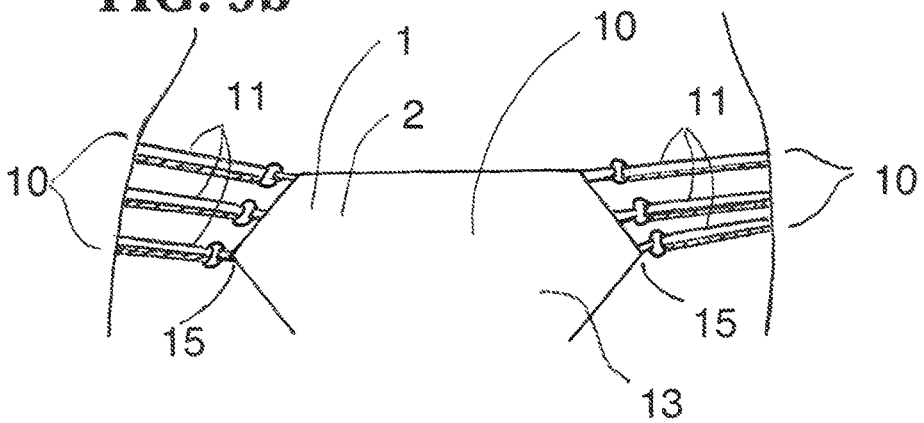
FIG. 3*b* is a rear cut away view of the garment with adjustable waistband section.

FIGS. 3*a* and 3*b* illustrate that the adjustable waistband 10 of the garment 1, 2 comprises the adjustable straps 11, and the areas of the front panel 12 and rear panel 13 adjacent to the connecting adjustable straps 11.

Figure 3C:
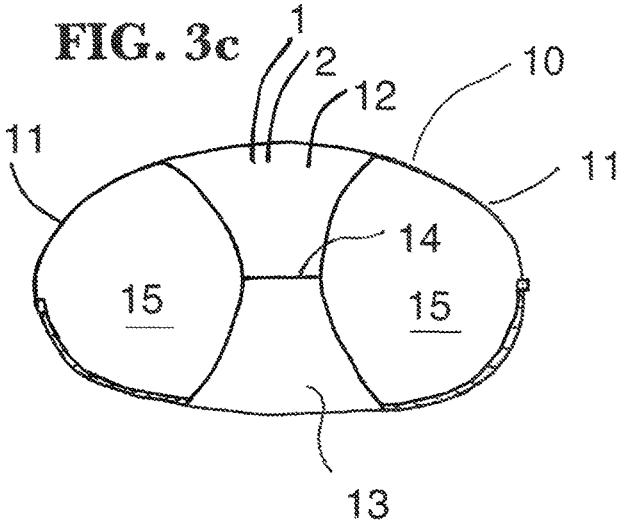
FIG. 3*c* is a bird's eye view of the garment, illustrating the circumference of the adjustable waistband, and its components.

These adjustable strap(s) 11 will be attached to the front panel 12 and the rear panel 13, in a circumferential manner FIG. 3*c*, so that the swim garment 1 will be held onto the body by the waistband 10, comprising the front panel 12, rear panel 13, and adjustable straps 11. The leg openings 15 may also be completed and defined by the joining of the front panel 12 and rear panel 13 by the adjustable straps, thus enabling the leg-openings 15 to also be adjustable in girth. FIG. 3*c* shows said leg openings 15 separated at the crotch section 14, where the front panel 12 and the rear panel 13 are connected between the legs.

Figure 4A:
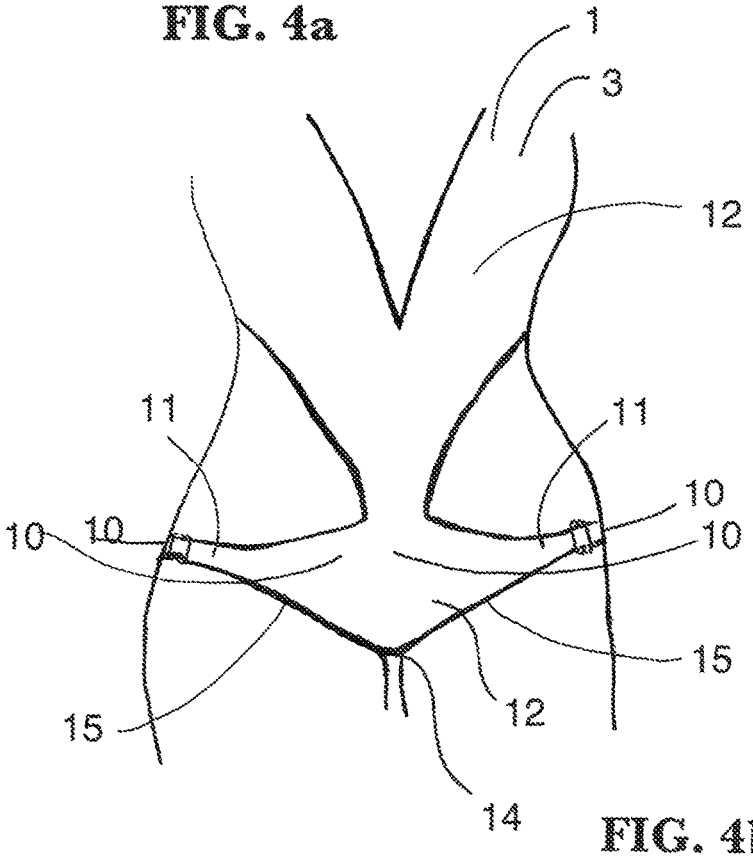
FIG. 4*a* is a frontal view of the swimsuit garment with adjustable waistband. Example of embodiment of one-piece swimsuit with paired set of singular adjustable straps composing adjustable section of waistband.
Figure 4B:
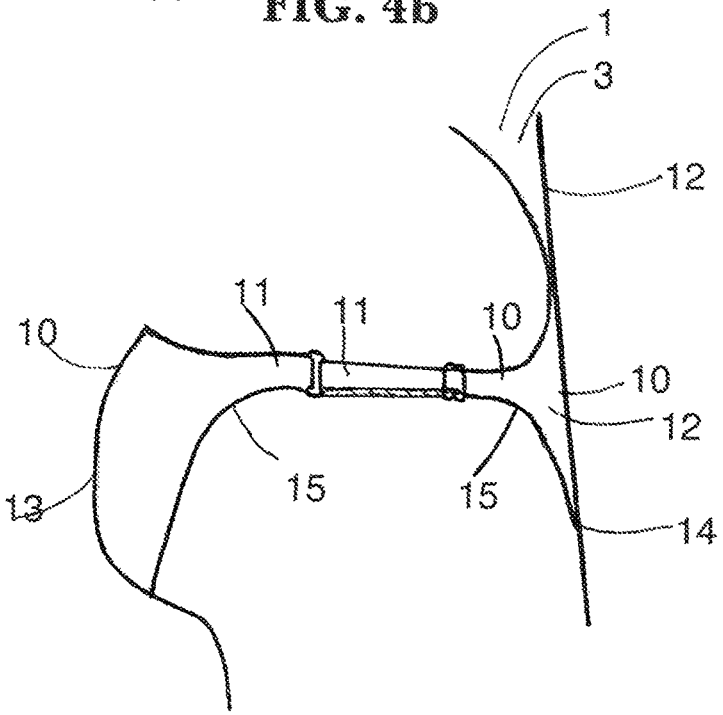
FIG. 4*b* is a side view of the swimsuit garment with adjustable waistband. Example of embodiment of one-piece swimsuit with paired set of singular adjustable straps composing adjustable section of waistband.

FIGS. 4*a* and 4*b* display a ramification of a one-piece embodiment 3 of the swim garment 1 wherein the front panel 12 is enlarged and fashioned to provide increased frontal coverage, such to cover the breasts, allowing the garment to be used as a one-piece swimsuit 3. In this pictured one-piece embodiment 3, the waistband 10 includes a paired set of singular adjustable straps 11 on the sides of the garment 3, to illustrate a variation of the look of the adjustable waistband section 10. The basic components of the adjustable waistband 10, are present: front panel 12, rear panel 13, adjustable straps 11, though the front panel 12, provides more coverage than in the previous bikini bottom embodiment 2. On an embodiment such as a one-piece swimsuit 3, means of attaching the top of the one-piece swimsuit 3 to the body are variable, and do not affect the present invention pertaining to the adjustability of the lower section and waistband 10 area of the swimsuit 3, thus are not shown in FIGS. 4*a* and 4*b*.

FIGS. 5*a*, 5*b*, 5*c*, and 5*d*, display an increased coverage variation 4 on the bikini bottom embodiment 2 of the adjustable waistband swim garment 1, wherein the bottom 4 provides more coverage for the user in the front panel 12 and the rear panel 13 which adds a level of modesty. The front panel 12 and rear panel 13 are joined by the adjustable straps 11 creating the girth of the adjustable waistband 10. Due to the increased coverage of the bikini garment 4, the section defined as waistband 10 on this bikini garment 4 encompasses a larger area than on aforementioned more scant embodiments. The waistband 10 includes the space on the panels 12, 13, adjacent to the adjustable straps 11 connecting the panels 12, 13, meaning much of the garment's 4 girth is adjustable through the waistband 10 adjustability features (straps) 11.

Further, the adjustable straps that are situated along the sides of the garment 4, tend to connect the panels 12, 13, in lower areas on the side of the body than other variations of the bikini bottom 2. Thus, the waistband 10 circumference, as well as the girth of the leg openings 15, and girth of the entire garment 1 are adjustable through the adjustable straps 11. More of the upper leg area of the user is encircled with adjustable straps 11 within such an embodiment, than in less-covering versions of the adjustable swim garment 1.

Figure 5B:
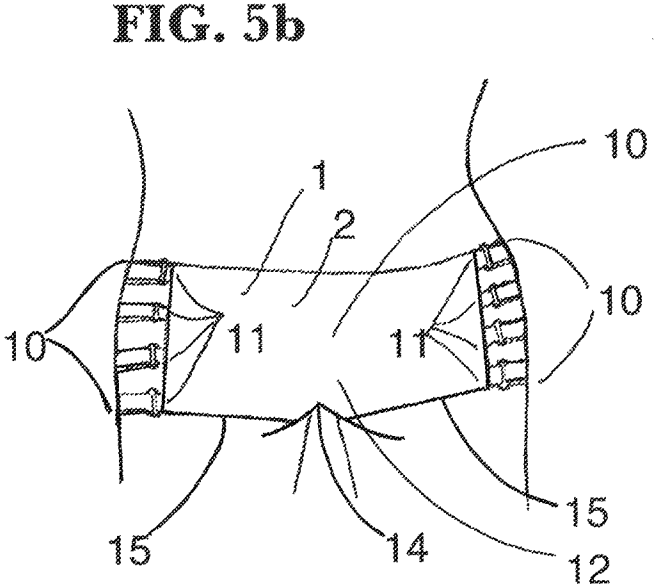
FIG. 5*b* is a back view of the swimsuit garment with adjustable waistband. Example of embodiment illustrates a "short" style bikini bottom, offering more coverage or to user.
Figure 5A:
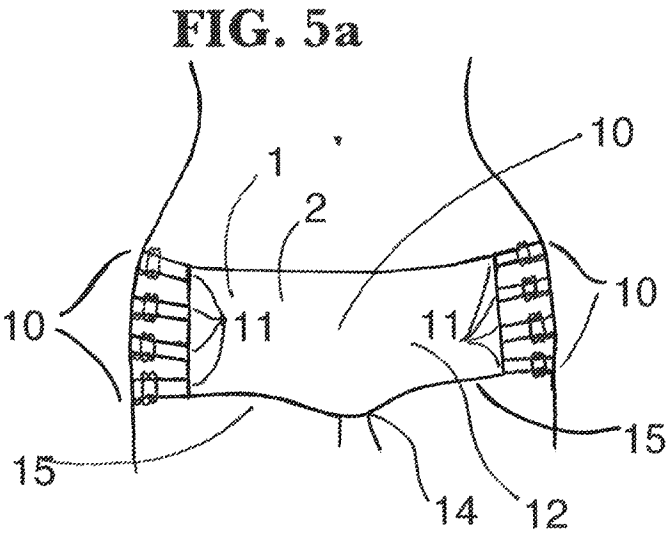
FIG. 5*a* is a frontal view of the swimsuit garment with adjustable waistband. Example of embodiment illustrates a "short" style bikini bottom, offering more coverage or to user. Multiple adjustable straps laterally connecting the front and rear panels are used, and offer adjustability to the width of the entire garment, not limited to the waistband.
Figure 5D:
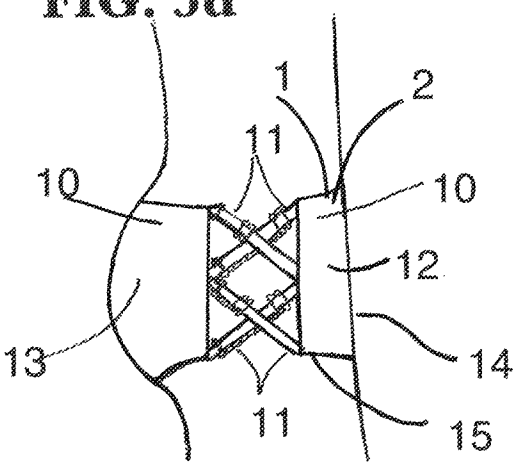
FIG. 5*d* is a side view of the swimsuit garment with adjustable waistband. Example of embodiment illustrates adjustable straps situated in a diagonal fashion, still providing width adjustability in the garment.
Figure 5C:
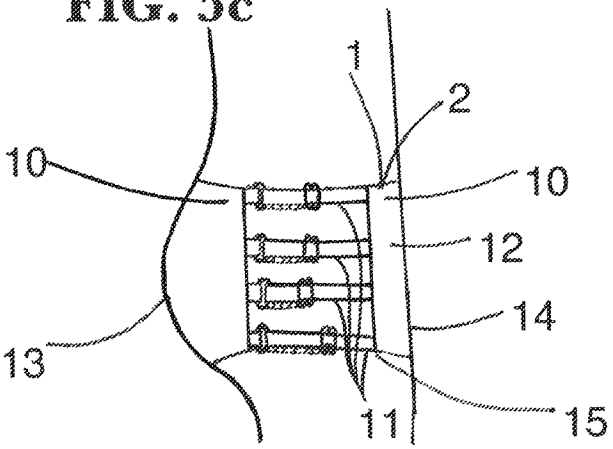
FIG. 5*c* is a side view of the swimsuit garment with adjustable waistband. Example of embodiment illustrates a "short" style bikini bottom, offering more coverage or to user.

FIG. 5*d* displays an alternate diagonal placement of the adjustable straps 11 between the front 12 and rear 13 panels, wherein the waistband 10 retains it's girth adjustability.

Figure 6:
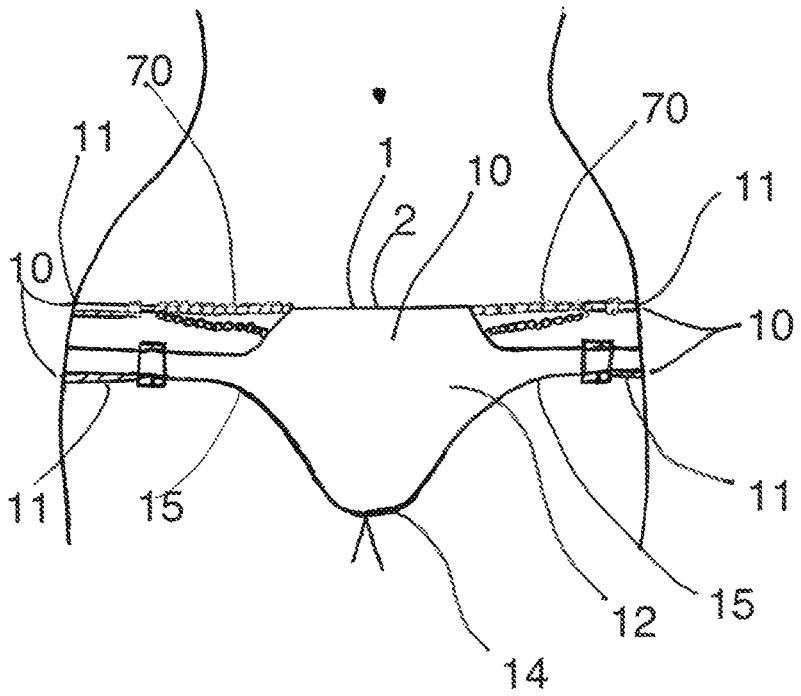
FIG. 6 is a front view of the swimsuit garment with adjustable waistband. Example is bikini bottom embodiment wherein embellishments attached to front panel of swimsuit are included in the composition of the adjustable waistband.

FIG. 6 displays a frontal view of the swimsuit garment with adjustable waistband 1, bikini embodiment 2, wherein embellishments 70 attached to front panel 12 of bikini bottom garment 2, and the adjustable straps 11, and are also included in the composition and girth of the adjustable waistband section 10.

Figure 7:
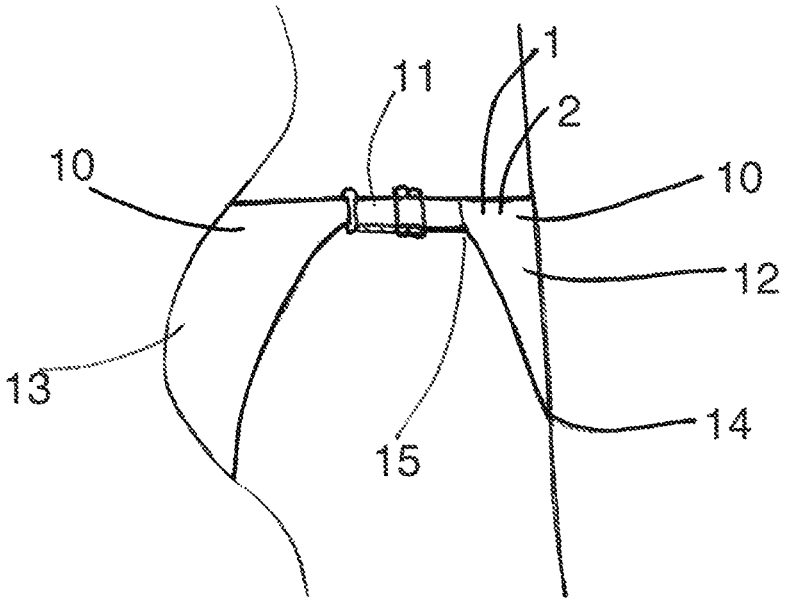
FIG. 7 is a side view of the swimsuit garment with adjustable waistband. Example of bikini bottom with set of singular adjustable straps composing adjustable section of waistband.

FIG. 7 is a side view of the swimsuit garment with adjustable waistband 1, in a bikini bottom 2 embodiment, with an adjustable waistband 10 that includes a set of adjustable straps 11 composing adjustable section of waistband, rather than multiple straps as shown in previous examples. Similar to other examples, waistband section 10 is comprised of the sections of the front panel 12 and rear panel 13 adjacent to the adjustable straps 11, and the adjustable straps 11.

Figure 8:
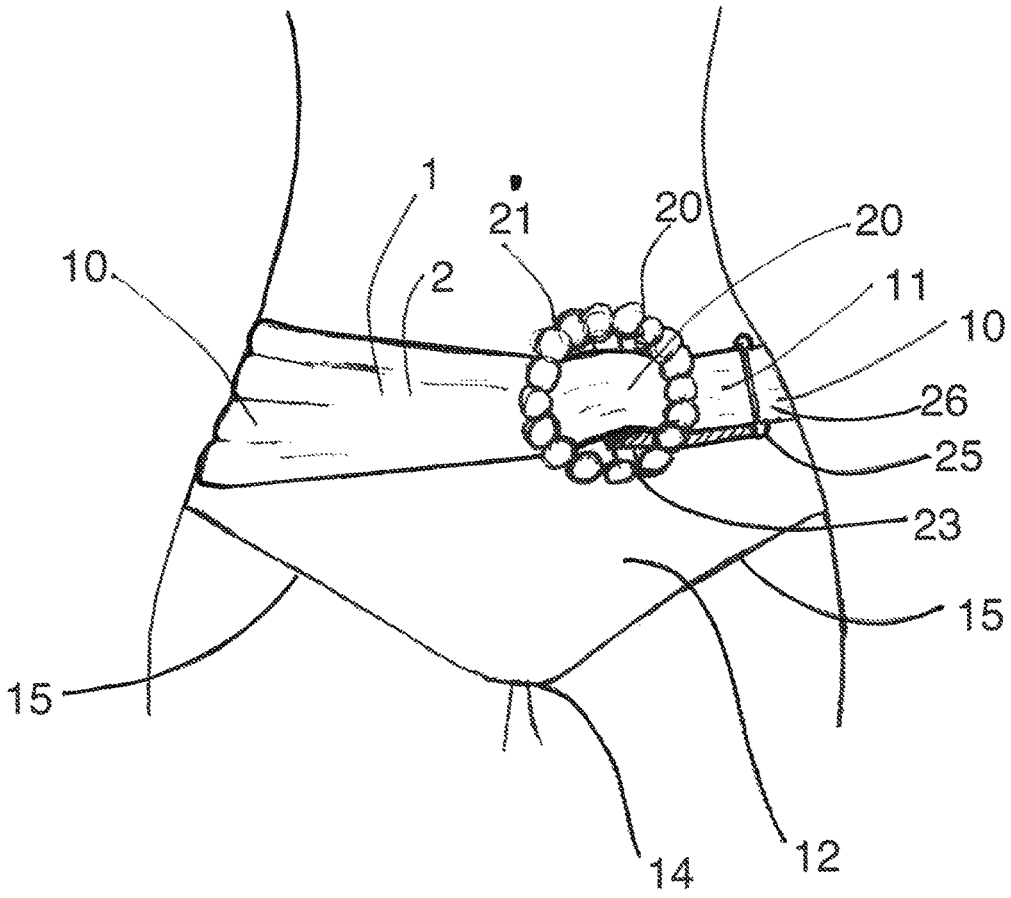
FIG. 8 is a front view of the swimsuit garment with adjustable waistband. Example is bikini bottom embodiment wherein only one adjustable strap is used to add adjustability to waistband, and strap is embellished, and is situated atop the front panel rather than at the sides.

FIG. 8 displays a frontal view of a ramification of the adjustable waistband swimsuit garment 1, in an embodiment in which the adjustable straps 11 are not on the sides of the garment as displayed in previous embodiments, but rather, one larger and embellished adjustable strap 11 is attached to the front panel 12 in such a way that the waistband 10 comprised of the adjustable strap 11, the areas of the rear panel 13 and front panel 12 adjacent to the adjustable strap 11, and also overlapped by the adjustable strap 11. The waistband 10 section of the garment 1, is adjustable by means of the adjustable strap 11 positioned in the front of the waistband 10. In this embodiment, the front and rear panels 12, 13 are attached together directly, without additional adjustable straps 11 connecting the front panel 12 to the rear panel 13.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An article of clothing in the form of a bikini bottom comprising:

a main body comprising one or more pieces of fabric formed collectively to fit between the wearer's legs and cover the wearer's pubic region at a front end and buttocks region at a rear end of the main body;

an adjustable waistband coupling the front end and rear end to form an opening for the wearer's waist, where the adjustable waistband comprises:

one or more straps of fabric; and one or more slidable adjustment mechanisms coupled to the one or more straps of fabric such that adjustment of the waistband is effected by sliding the one or more adjustment mechanisms along the one or more straps of fabric; and adjustable leg bands coupling the front and rear ends of the main body to form openings for the wearer's legs, each of the adjustable leg bands comprising one or more additional straps of fabric and one or more additional slidable adjustment mechanisms coupled to the additional straps of fabric such that adjustment of the leg bands is effected by sliding the one or more additional adjustment mechanisms along the one or more additional straps of fabric.

2. The article of clothing of claim 1, wherein the adjustable waistband comprises:

at least two straps of fabric positioned such that at least one sits on each side of the wearer's torso; and at least two slidable adjustment mechanisms coupled to the straps of fabric and positioned such that at least one sits on each side of the wearer's torso.

3. The article of clothing of claim 1, wherein the article of clothing further comprises one or more loops, each anchored to the fabric of the main body or to one of the adjustable leg bands, and each positioned to receive one end of one of the straps of fabric of the adjustable leg bands.

4. The article of clothing of claim 3, wherein each of the ends that is received by one of the loops also attaches to one of the slidable adjustment mechanisms.

5. The article of clothing of claim 4, wherein each of the slidable adjustment mechanisms is positioned to slide along the strap of fabric whose end attaches to it.

6. The article of clothing of claim 3, wherein each loop is coupled to at least one of the straps of fabric in a manner that creates leverage for the strap of fabric as the adjustment mechanism slides along it.

7. The article of clothing of claim 1, wherein the fabric comprising the main body includes at least one material selected from the group consisting of LYCRA, spandex, elastane, nylon, or a polyester blend.

* * * * *